US005643643A

United States Patent [19]

Bernstein

[11] Patent Number: 5,643,643

[45] Date of Patent: Jul. 1, 1997

[54] APPAREL ACCESSORY

[76] Inventor: Ruth B. Bernstein, 5330-33rd Ave. North, Golden Valley, Minn. 55422

[21] Appl. No.: 765,598

[22] Filed: Sep. 26, 1991

[51] Int. Cl.[6] ..... D04D 7/06

[52] U.S. Cl. ..... 428/5; 2/244; 156/70; 428/4; 428/101; 428/121

[58] Field of Search ..... 428/121, 151, 428/198, 102, 4, 5, 101, 152, 192; 2/311, 312, 49, 338, 244, 91, 207, 216, 217; 156/70

[56] References Cited

U.S. PATENT DOCUMENTS

| | | | |
|---|---|---|---|
| 2,883,670 | 4/1959 | Pratt | 2/207 |
| 2,980,916 | 4/1961 | Lennemann | 2/215 |
| 4,468,818 | 9/1984 | Flannery | 2/207 |
| 4,556,596 | 12/1985 | Meuli | 428/152 |
| 4,777,066 | 10/1988 | White et al. | 428/4 |
| 4,935,287 | 6/1990 | Johnson et al. | 428/152 |
| 5,007,115 | 4/1991 | Denbow et al. | 2/208 |
| 5,025,508 | 6/1991 | Duncan | 2/207 |

OTHER PUBLICATIONS

Sewing notion sold under the trademark "Land O'Lace" by Emanuel Roth Co., a division of Novtex Corp., 510 State Road, North Adams, MA 01247 (date unkown).

*Primary Examiner*—James J. Bell

*Attorney, Agent, or Firm*—Peterson, Wicks, Nemer & Kamrath, P.A.

[57] ABSTRACT

An apparel accessory (10) is disclosed including a scarf body (12) formed by folding a sheet (20) of fabric to create first and second layers (22, 24) overlying each other and having staggered, free longitudinal edges. First and second, parallel, spaced, longitudinal rows of stitches (26, 28) extend through layers (22, 24) generally intermediate the longitudinal edges of the scarf body (12) and form and define a tunnel (30) for frictionally, slideably receiving a drawstring (16). By pushing the scarf body (12) relative to the drawstring (16), the scarf body (12) can be variably held in a gathered, three dimensional condition on the drawstring (16) for draping on the wearer in a variety of positions and modes. The portions of the drawstring (16) beyond the scarf body (12) in its gathered condition provide tying provisions for the accessory (10) for tying the ends together and/or for tying the ends to the clothing of the wearer.

23 Claims, 2 Drawing Sheets

2
2

APPAREL ACCESSORY

BACKGROUND

The present invention generally relates to accessories to be worn with apparel, and specifically to apparel accessories which give clothing of the wearer the feel and look of new and variable outfits.

It is often desirable to wear accessories with articles of clothing to give the clothing a different appearance. For example, clothing can be worn without the accessory or with the accessory which may also be variably positioned to provide an overall different appearance. For example, it may be desirable to change the clothing appearance in such a way that a single outfit can be worn at different social occasions to effectively increase the wearer's wardrobe. Likewise, It may be desirable to change the clothing appearance such that a simple outfit will have a more elegant appearance. One prior approach was to utilize scarfs which could be optionally worn with outfits. However, prior scarfs had severe limitations which adversely affected the manner and ways that they could be worn. Specifically, prior scarves tended to have a square or rectangular configuration, with the lengths of the sides being relatively small with respect to or equal to the dimensions of the wearer. Further, to tie prior scarves in order for them to remain in a fixed position, it was necessary to tie the corners or wide ends of the fabric thereby reducing the amount of fabric available for positioning around the wearer and making a large, bulky, hideous knot. Likewise, prior scarves had a generally flat condition which was generally coextensive with the other articles of clothing worn by the wearer. Thus, prior scarves provided only minor changes in the three dimensional appearance of the clothing. Historically, the only real variety in scarves came in the form of changes in fabric design and/or color.

Thus, a need exists for apparel accessories which are new and different from prior apparel accessories and which give clothing the feel and look of many different outfits and which would be appropriate for a variety of types of clothing from sportswear to elegant, from mass market to designer/couturier.

SUMMARY

The present invention solves this need and other problems in the field of apparel accessories by providing a body formed of at least a first layer of flexible material which is variably held in a gathered, three dimensional condition having a fixed, shortened length and which is draped on the wearer and relative to the clothing of the wearer. In the preferred form, the body is slid and held relative to a drawstring, with the portions of the drawstring extending beyond the body in its gathered, three dimensional condition providing tying provisions for the body.

It is thus an object of the present invention to provide a novel accessory to be worn with apparel.

It is further an object of the present invention to provide such a novel apparel accessory which is variably held in a gathered, three dimensional condition.

It is further an object of the present invention to provide such a novel apparel accessory including slender tying means for facilitating tying the ends of the apparel accessory.

It is further an object of the present invention to provide such a novel apparel accessory which can be draped on the wearer in a variety of positions and modes.

It is further an object of the present invention to provide such a novel apparel accessory of an elongated length relative to the dimensions of the wearer around which the apparel accessory is worn.

It is further an object of the present invention to provide such a novel apparel accessory which can be worn with a variety of types of clothing.

It is further an object of the present invention to provide such a novel apparel accessory which provides a new look and feel to clothing.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2, 3:
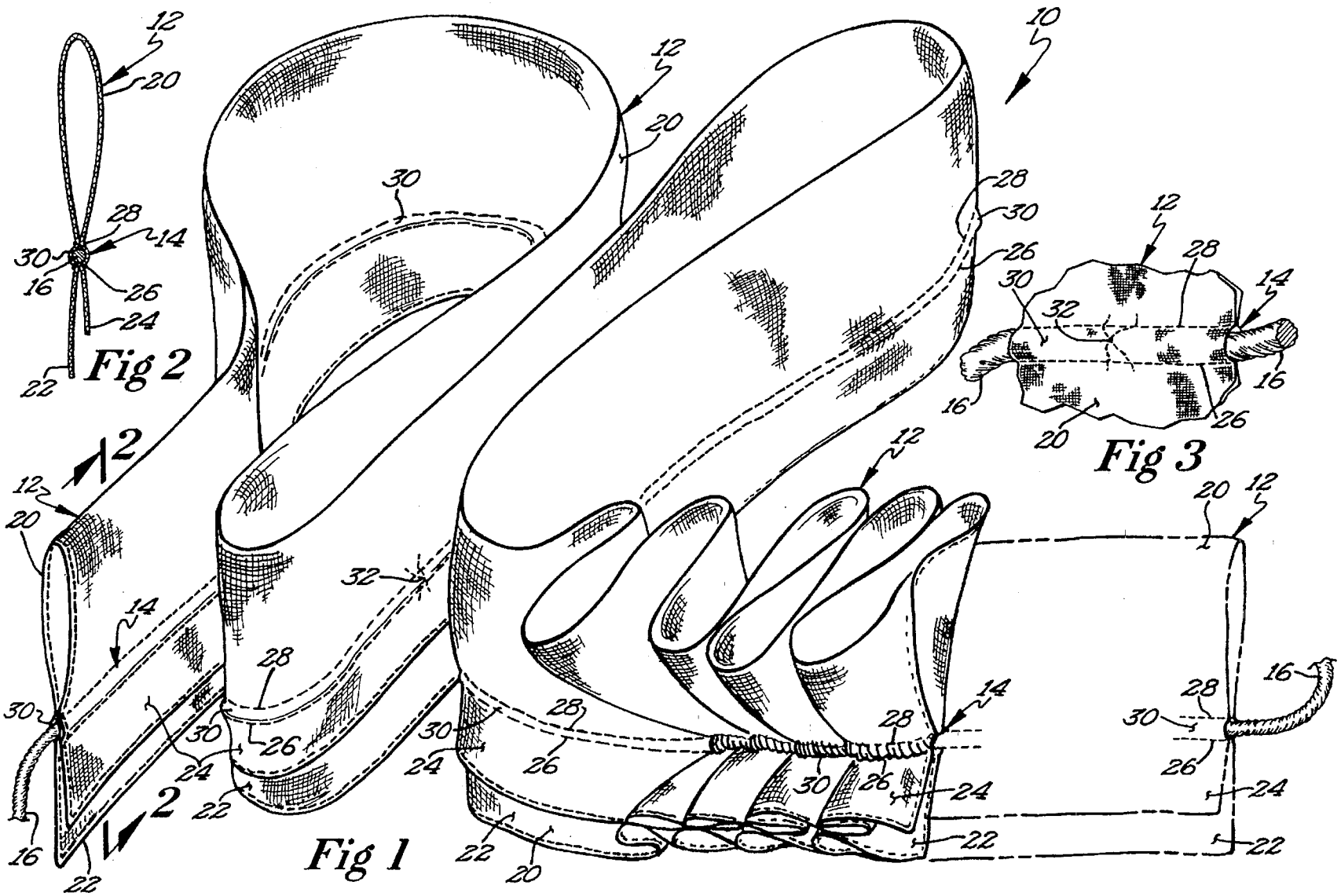
FIG. 1 shows a perspective view of an apparel accessory according to the preferred teachings of the present invention, with the right end thereof being initially gathered.
FIG. 2 shows a cross sectional view of the apparel accessory of FIG. 1 according to section line 2—2 of FIG. 1.
FIG. 3 shows an enlarged view of the longitudinal center of the apparel accessory of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "edge", "longitudinal", and similar terms are used herein, it should be understood that these terms have reference only to the structure shown in the drawings as it would appear to a person viewing the drawings and are utilized only to facilitate describing the invention.

Description

An apparel accessory according to the preferred teachings of the present invention is shown in the drawings and generally designated 10. Generally, accessory 10 includes a scarf body 12 formed of one or more layers of fabric material. Accessory 10 further includes provisions 14 for variably gathering scarf body 12 to any desired degree. Particularly, provisions 14 include a drawstring 16 slideably mounted relative to scarf body 12 by suitable constructions.

In a first preferred form of the present invention, a sheet 20 of flexible material such as fabric is utilized having an elongated length and in the preferred form has a length which is a multiple of its width and in the most preferred form has a length of approximately nine feet (3 meters) and a width of approximately one foot (30 centimeters) which is nine times its width. The length of sheet 20 and of body 12 is elongated and larger than the dimensions of the wearer of accessory 10 around which accessory 10 will be worn. Sheet 20 is folded over to form a first layer 22 overlying a second layer 24 having integral first edges. In the most preferred form, the second, free edges of layers 22 and 24 are staggered with the edge of layer 24 being located inwardly of the edge of layer 22 for aesthetic effect.

First and second, parallel, spaced, longitudinal rows of stitches 26 and 28 secure layers 22 and 24 together and extend the full length of sheet 20 generally spaced from, intermediate and parallel to the first and second longitudinal edges of layers 22 and 24 and of scarf body 12. It can then be appreciated that a tunnel 30 is formed by layers 22 and 24 between stitches 26 and 28, with tunnel 30 having a size and shape for frictionally slideably receiving drawstring 16 in the most preferred form. It can further be appreciated that body 12 is formed and defined by layers 22 and 24. In the preferred form, the longitudinal center of drawstring 16 is anchored to the longitudinal center of scarf body 12 such as by stitches 32 extending through tunnel 30 and drawstring 16.

Drawstring 16 has a length at least equal to and preferably greater than the length of body 12 and sheet 20. Drawstring 16 can be formed of any suitable material such as but not limited to a string created from the same fabric forming sheet 20, a cord, a ribbon, an elastic band, or any other slender, rope like material.

In operation, while drawstring 16 is held stationary, the ends of scarf body 12 are pushed relative to drawstring 16 toward the longitudinal center of scarf body 12 and drawstring 16 to assume a shortened longitudinal length as desired, causing scarf body 12 to become touched or gathered and have a three dimensioned condition due to the decreasing length of scarf body 12 and the constant length of drawstring 16. It can then be appreciated that due to the friction slideable fit of drawstring 16 relative to tunnel 30 of scarf body 12 in the most preferred form, scarf body 12 will remain in its gathered, three dimensional condition of a fixed length on drawstring 16, with the fixed length of body 12 in its gathered condition being less than the elongated length of sheet 20 or in other words of body 12 prior to its gathered condition. It can further be appreciated that the degree of gathering is variable based upon the amount that scarf body 12 is pushed relative to drawstring 16, with the greater the amount that scarf body 12 is pushed the greater the degree of gathering. The consistency of gathering of scarf body 12 between the shortened length of scarf body 12 on drawstring 16 can be manually adjusted by sliding scarf body 12 relative to drawstring 16 intermediate the ends of tunnel 30. It should then be further appreciated that with scarf body 12 in a gathered, shortened condition on drawstring 16 which retains its original length, the distance or length of the portions of drawstring 16 beyond the ends of scarf body 12 increases corresponding to the decreasing length of scarf body 12 relative to drawstring 16.

Figure 5:
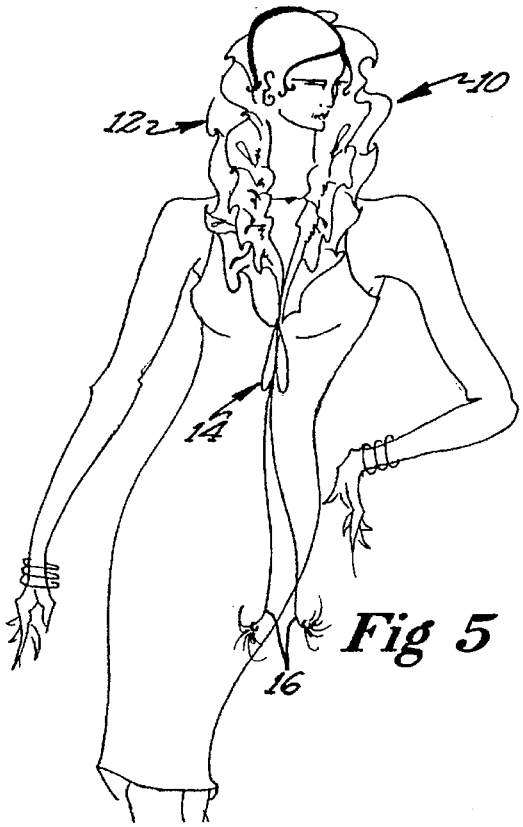

After scarf body 12 has been gathered to the desired extent, accessory 10 can be positioned or draped around the wearer at any one of multiple desired positions and/or modes depending upon the proportions of apparel accessory 10. In this regard, the portions of drawstring 16 extending beyond scarf body 12 provide slender tying means for facilitating tying the two ends of accessory 10 together as opposed to having to tie two corners or wide ends of fabric and/or for facilitating anchoring the ends of accessory 10 to articles of clothing. Further, accessory 10 according to the preferred teachings of the present invention can be fastened to articles of clothing of the wearer adjacent its ends or any portion intermediate thereto by any suitable means such as by pins, jewelry, or the like. For example, as shown in FIG. 5, accessory 10 according to the preferred teachings of the present invention can be loosely wrapped around the neck of the wearer to follow the neckline of the jacket or top of the wearer being either in an annular shape with the ends of drawstring 16 tied together or in a horseshoe shape. In an alternate form, accessory 10 can be partially placed under the neckline of the jacket or the top of the wearer's apparel. Similarly, accessory 10 can be looped around the wearer's neck with accessory 10 draped downwardly from the back of the neck, for example to follow a low cut back of the top of the wearer's apparel. Also, accessory 10 according to the preferred teachings of the present invention can be worn suspender fashion. Likewise, accessory 10 can be wrapped loosely or tightly around and generally concentric to the neck of the wearer.

Figure 4:
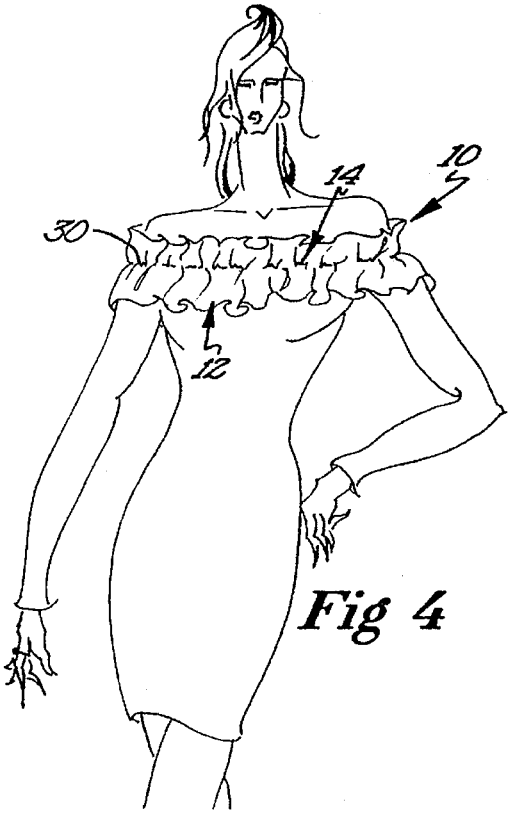
FIGS. 4–6 show front views of the apparel accessory of FIG. 1 illustrating manners in which the apparel accessory can be draped on the wearer.

Further, accessory 10 according to the preferred teachings of the present invention can be wrapped generally horizontally around the body of the wearer such as shown in FIG. 4 where accessory 10 is placed to give the appearance of an off the shoulder top to the wearer's garment. Similarly, accessory 10 can be placed to follow the bodice of a strapless or spaghetti strap top. Likewise, accessory 10 can be wrapped around the waist of the wearer, in either a tight or loose fashion. Further, accessory 10 can be placed to follow the hem of a skirt or dress.

Figure 6:
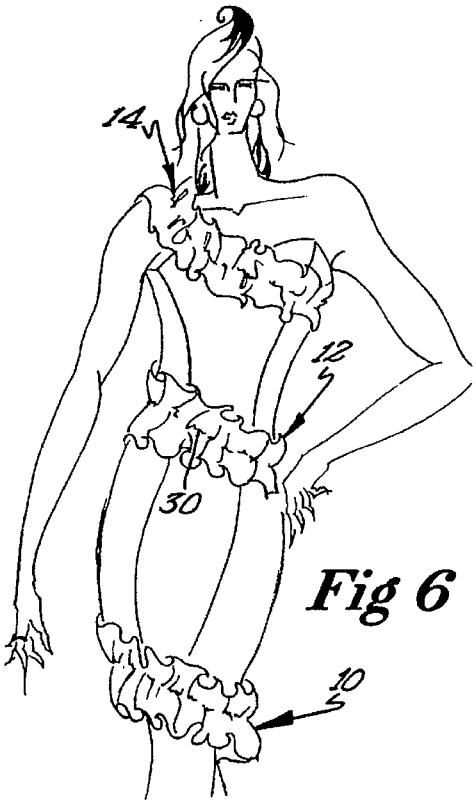

Furthermore, accessory 10 according to the preferred teachings of the present invention can be wrapped spirally from shoulder to hip and/or from hip to hem as shown in FIG. 6. Similarly, accessory 10 according to the preferred teachings of the present invention can be placed diagonally from shoulder to hip and/or from waist to hem, with accessory 10 being either in an annular shape with the ends of drawstring 16 tied together or in a horseshoe shape. Likewise, accessory 10 according to the preferred teachings of the present invention can be worn stole or double stole fashion or in a bolero style.

It can then be realized that due to the proportions of accessory 10 and the quasimechanical adaptation of gathering provisions 14 to scarf body 12, the possibilities of use and wear of accessory 10 according to the preferred teachings of the present invention are limited only by the ingenuity and creativity of the wearer.

After use, scarf body 12 can be stretched to its full length on drawstring 16 by holding drawstring 16 and pulling scarf body 12 relative thereto. In its stretched, ungathered condition, scarf body 12 and drawstring 16 can be easily folded for compact storage such as in a purse or a drawer.

It can then be appreciated that accessory 10 according to the preferred teachings of the present invention provides an elegant, dimensional look to a simple outfit. Further, by changing the position and orientation of accessory 10, accessory 10 according to the preferred teachings of the present invention allows a single outfit to take on multiple appearances. Thus, due to the extreme flexibility inherent in accessory 10 according to the preferred teachings of the present invention, the wardrobe of the wearer can be effectively increased while minimizing the number of outfits needed. For example, accessory 10 according to the preferred teachings of the present invention is particularly advantageous for travelers, where a limited number of outfits can be aesthetically changed to allow multiple wearings with different looks such as for formal and informal occasions and/or for wearing on multiple occasions without the same appearance.

Now that the basic teachings of the present invention have been explained, many extensions and variations will be obvious to one having ordinary skill in the art. For example, although drawstring 16 and tunnel 30 are shown and described located generally intermediate and parallel to the longitudinal edges of body 12 according to the preferred teachings of the present invention, it can be appreciated that accessory 10 can be constructed with variably gathering provisions 14 positioned at other locations extending in a direction generally parallel to the longitudinal edges of body 12 including but not limited to adjacent and parallel to one of the longitudinal edges of body 12.

Similarly, although scarf body 12 is shown in the most preferred form of the present invention as formed from a single sheet 20 folded to form layers 22 and 24, it can be appreciated that scarf body 12 can take other forms and shapes according to the teachings of the present invention. For example, body 12 can be formed from a single layer or from multiple layers having none, one, or both of the longitudinal edges of body 12 secured together and with the multiple layers formed from a single sheet or multiple sheets.

Likewise, although variably gathering provisions 14 according to the most preferred form of the present invention are formed as tunnel 30 for frictionally slideably receiving drawstring 16, it can be appreciated that variably gathering provisions 14 can take other forms according to the teachings of the present invention. For example, tunnel 30 could be formed by an additional overlayment of a long narrow ribbon of material with its edges stitched to scarf body 12. Further, drawstring 16 can be laced by various means to scarf body 12 according to the preferred teachings of the present invention. Specifically, drawstring 16 could be laced in and out of scarf body 12 through button holes, grommets, or similar holes in scarf body 12. Likewise, drawstring 16 could be laced parallel to scarf body 12 through loops or rings extending from and attached to scarf body 12. It can be appreciated that such holes, grommets, loops or rings can be spaced equally or randomly in a longitudinal direction along scarf body 12 to change the gathered condition and aesthetic appearance of accessory 10 according to the teachings of the present invention. It can then be similarly appreciated that variably gathering provisions 14 can include other provisions for holding scarf body 12 in its gathered condition on drawstring 16 other than the friction slideable fit of drawstring 16 inside of tunnel 30 as in the most preferred form of the present invention. For example, knots could be tied in drawstring 16 or clips could be removably fixed to drawstring 16 for abutting with the outside ends of the provisions for slideably mounting scarf body 12 relative to drawstring 16.

Similarly, although variably gathering provisions 14 are shown in the most preferred form of the present invention as a single drawstring 16 slideably received in tunnel 30, accessory 10 according to the teachings of the present invention can include multiple variably gathering provisions 14.

Further, although sheet 20 is shown in the most preferred form of the present invention as formed of fabric, sheet 20 according to the teachings of the present invention can be formed of other flexible materials such as but not limited to crochet, knit or lace material, fur, leather, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Apparel accessory comprising, in combination: a body having first and second free ends and formed of at least a first layer of flexible material including but not limited to fabric and having a width and an elongated length between the first and second free ends; and means for variably holding the body in a gathered, three dimensional condition with the first and second ends remaining free, with the body in the gathered condition having a fixed length between the first and second free ends less than the elongated length of the body, with the body in the gathered condition being drapable on the wearer.

2. The apparel accessory of claim 1 wherein the body includes first and second longitudinal free edges, with the variably holding means located generally intermediate the first and second longitudinal edges of the body.

3. The apparel accessory of claim 2 wherein the variably holding means comprises, in combination: a drawstring having first and second ends and a length at least equal to the elongated length of the body; and means for slideably mounting the body relative to the drawstring with the body being spaced from the first and second ends of the drawstring, with the portions of the drawstring between the first and second ends of the drawstring and the body providing tying provisions for the body in the gathered condition.

4. The apparel accessory of claim 3 wherein the slideably mounting means comprises means on the body for frictionally slideably receiving the drawstring.

5. The apparel accessory of claim 4 wherein the slideably mounting means comprises a tunnel formed in the body for frictionally slideably receiving the drawstring.

6. The apparel accessory of claim 5 wherein the body is further formed of a second layer of flexible material overlying the first layer, with the tunnel formed and defined by first and second, parallel rows of stitches extending through the first and second layers.

7. The apparel accessory of claim 6 wherein each of the first and second layers include first and second edges, with the first edges of the first and second layers being integral, with the first and second layers being folded about their first edges to form the body.

8. The apparel accessory of claim 7 wherein the second edges of the first and second layers are staggered.

9. The apparel accessory of claim 8 wherein the tunnel is parallel to and spaced from the first and second edges of the first and second layers.

10. The apparel accessory of claim 2 wherein the body is further formed of a second layer of flexible material overlying the first layer.

11. The apparel accessory of claim 10 wherein each of the first and second layers include first and second edges, with the first edges of the first and second layers being integral, with the first and second layers being folded about their first edges to form the body.

12. The apparel accessory of claim 11 wherein the second edges of the first and second layers are staggered.

13. The apparel accessory of claim 1 wherein the body is further formed of a second layer of flexible material overlying the first layer.

14. The apparel accessory of claim 1 wherein the variably holding means comprises, an combination: a drawstring having first and second ends and a length at least equal to the elongated length of the body; and means for slideably mounting the body relative to the drawstring with the body being spaced from the first and second ends of the drawstring, with the portions of the drawstring between the first and second ends of the drawstring and the body providing tying provisions for the body in the gathered condition.

15. The apparel accessory of claim 14 wherein the slideably mounting means comprises means on the body for frictionally slideably receiving the drawstring.

16. The apparel accessory of claim 15 wherein the slideably mounting means comprises a tunnel formed in the body for frictionally slideably receiving the drawstring.

17. Method for changing the appearance of clothing of a wearer comprising the steps of: providing a body having first and second free ends and formed of at least a first layer of flexible material having a width and an elongated length between the first and second ends; variably holding the body in a gathered, three dimensional condition with the first and second ends remaining free, with the body in the gathered condition having a fixed length between the first and second free ends less than the elongated length of the body; and draping the body in the gathered condition on the wearer and relative to the clothing of the wearer.

18. The method of claim 17 wherein the variably holding step comprises the steps of: providing a drawstring having first and second ends and a length at least equal to the elongated length of the body, and slideably mounting the body relative to the drawstring with the body being spaced from the first and second ends of the drawstring; and wherein the method further comprises the step of tying the portions of the drawstring between the first and second ends of the drawstring and the body in the gathered condition.

19. The method of claim 18 wherein the tying step comprises the step of tying the portions of the drawstring together.

20. The method of claim 18 wherein the tying step comprises the step of tying the portions of the drawstring to the clothing of the wearer.

21. The method of claim 17 wherein the draping step comprises the step of at least partially wrapping the body in the gathered condition around the neck of the wearer.

22. The method of claim 17 wherein the draping step comprises the step of draping the body in the gathered condition on the wearer to be visually exposed relative to the outer clothing of the wearer.

23. The apparel accessory of claim 1 wherein the body in the gathered condition is loosely wrapped around the neck of the wearer to follow the neckline of the clothing of the wearer.

* * * * *